US005779135A

United States Patent [19]

Richardson

[11] Patent Number: 5,779,135

[45] Date of Patent: Jul. 14, 1998

[54] NESTED CONTAINER PACKAGE

[75] Inventor: Paul D. Richardson, Greenhills, Ohio

[73] Assignee: International Paper Company, Purchase, N.Y.

[21] Appl. No.: 744,636

[22] Filed: Nov. 6, 1996

[51] Int. Cl.[6] ..... B65D 83/00

[52] U.S. Cl. ..... 229/155; 221/305

[58] Field of Search ..... 229/155, 122.1, 229/132, 169; 221/305, 310; 206/499

[56] References Cited

U.S. PATENT DOCUMENTS

| | | | |
|---|---|---|---|
| 728,404 | 5/1903 | McGehee et al. . | |
| 2,506,962 | 5/1950 | Madan . | |
| 2,645,404 | 7/1953 | Buttery . | |
| 2,760,710 | 8/1956 | Fritz . | |
| 2,771,216 | 11/1956 | Reiner . | |
| 2,796,979 | 6/1957 | Buttery . | |
| 3,191,845 | 6/1965 | Wainberg . | |
| 3,283,100 | 11/1966 | Bonini . | |
| 3,366,311 | 1/1968 | Simpson et al. | 229/155 X |
| 3,368,734 | 2/1968 | Wainberg . | |
| 3,687,281 | 8/1972 | Prot . | |
| 4,063,678 | 12/1977 | Hall | 220/155 X |
| 4,163,508 | 8/1979 | Mannor . | |
| 4,216,897 | 8/1980 | Collura et al. . | |
| 4,482,079 | 11/1984 | Kuchenbecker | 221/310 |
| 4,520,946 | 6/1985 | Gould et al. . | |
| 5,044,493 | 9/1991 | Crawford et al. . | |

FOREIGN PATENT DOCUMENTS 532279 2/1993 Japan .

*Primary Examiner*—Steven M. Pollard
*Attorney, Agent, or Firm*—Michael J. Doyle

[57] ABSTRACT

A package for a plurality of thin walled, nested and stacked thin walled plastic tub containers and their tops. A paperboard carton is provided with an opening in its bottom panel through which the lower part of the nested stack of tubs extends. In use, the consumer opens two main roof panels, removes the desired number of tubs and tops, then reinserts the remaining nested tubs and tops back into the carton. The consumer then fastens the free ends of the two roof panels together by means of a tongue and slit latching arrangement. The two roof panels are initially held together by adhesive, the adhesive force being broken upon initial opening of the carton roof.

3 Claims, 3 Drawing Sheets

NESTED CONTAINER PACKAGE

BACKGROUND OF THE INVENTION

This invention relates to a package for nested plastic containers of the tub type. Such containers often assume the form of an elongated deep dish having an annularly continuous rim adapted to snappingly or releasably engage with a complementary shaped rim on a flat plastic cover or top. Such plastic tub containers are useful in the packaging of food, such as leftovers which are then refrigerated. While generally elongated, the tubs may be of short cylindrical form.

The tubs may be fashioned of relatively thick, moldable plastic, such as those marketed under the brand name Tupperware, or alternatively may be made much thinner and hence less expensive and designed for a limited number of reuses. In the case where the tub walls are relatively thin, it has been found convenient to package them for shipment and for sale in a nested configuration, with typically five nested tubs and five tops therefor placed in a generally parallelpiped paperboard carton having an opening in the bottom panel. In a known package of this type a bottom portion of the nested stack of tubs extends through this opening, with two opposite tongues, integral with the carton, lying in flat engagement with opposite sides of the extending portion of the nested stack. While this known arrangement has proven generally satisfactory, it has also displayed the drawback of being relatively difficult to assemble, employing latches at each of the four corners of the container to maintain the four front walls and two end walls (four sidewalls altogether) erect.

SUMMARY OF THE INVENTION

According to the practice of this invention, an improvement is made over such a known package of thin walled plastic tubs by providing a carton whose sidewalls are assembled by gluing operations and whose roof is reclosed by interengaging latches carried on opposite free edges of two main roof panels. This construction permits more rapid erection of the carton from the blank and also facilitates easy re-closure of the roof member after initial package opening. Glue spots are employed to hold the roof panels together prior to initial carton opening.

DETAILED DESCRIPTION OF THE INVENTION

Figure 1:
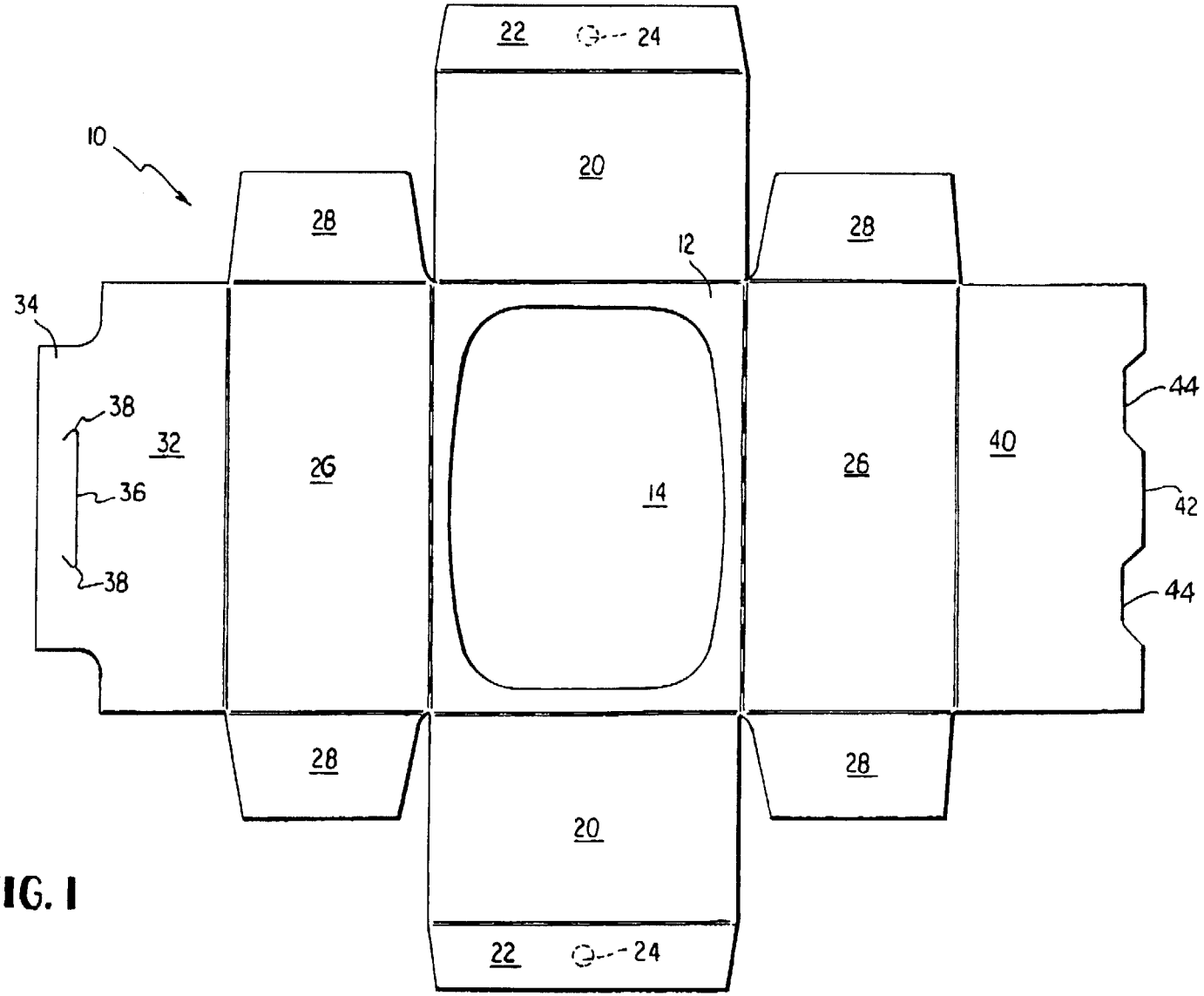
FIG. 1 is a plan view of a unitary blank of paperboard or other stiff, foldable and resilient sheet material from which the carton of the package is formed.

Referring now to FIG. 1 of the drawings, a unitary paperboard blank from which the carton of this invention is formed is denoted as 10. The blank is generally cross shaped and includes a central, bottom forming panel 12 having an opening 14 therein. A first pair of opposite end wall forming panels 20 is carried at the upper and lower portions of panel 12, with side wall forming panels 20, in turn, being integrally secured by the indicated fold lines to respective partial roof or tuck panels 22. These latter panels each carry a glue spot 24 for initially holding the two main roof panels closed prior to initial package opening.

The left portion of panel 12 is provided with an integral side wall forming panel 26, the latter having upper and lower panels 28 integrally coupled thereto through the indicated fold lines. The left end of side wall forming panel 26 is integrally secured by the indicated fold line to a first roof forming panel 32. Panel 32, at its leftmost portion, is of slightly reduced length, and this length includes a leftmost zone denoted generally as 34 adjacent the left free edge of panel 32. Zone 34 has a vertically extending cut line 36 having curved or bight portions 38, the cut 36 extending to short, straight terminal segments. The right edge of central or bottom panel 12 is coupled to another side wall forming panel 26, the right edge of the latter coupled by the indicated fold line to second roof panel 40. Roof panel 40 carries a free edge and a tongue 42 therealong between shallow cuts 44. Tongue 42 is located on a free edge of panel 40.

Figure 2:
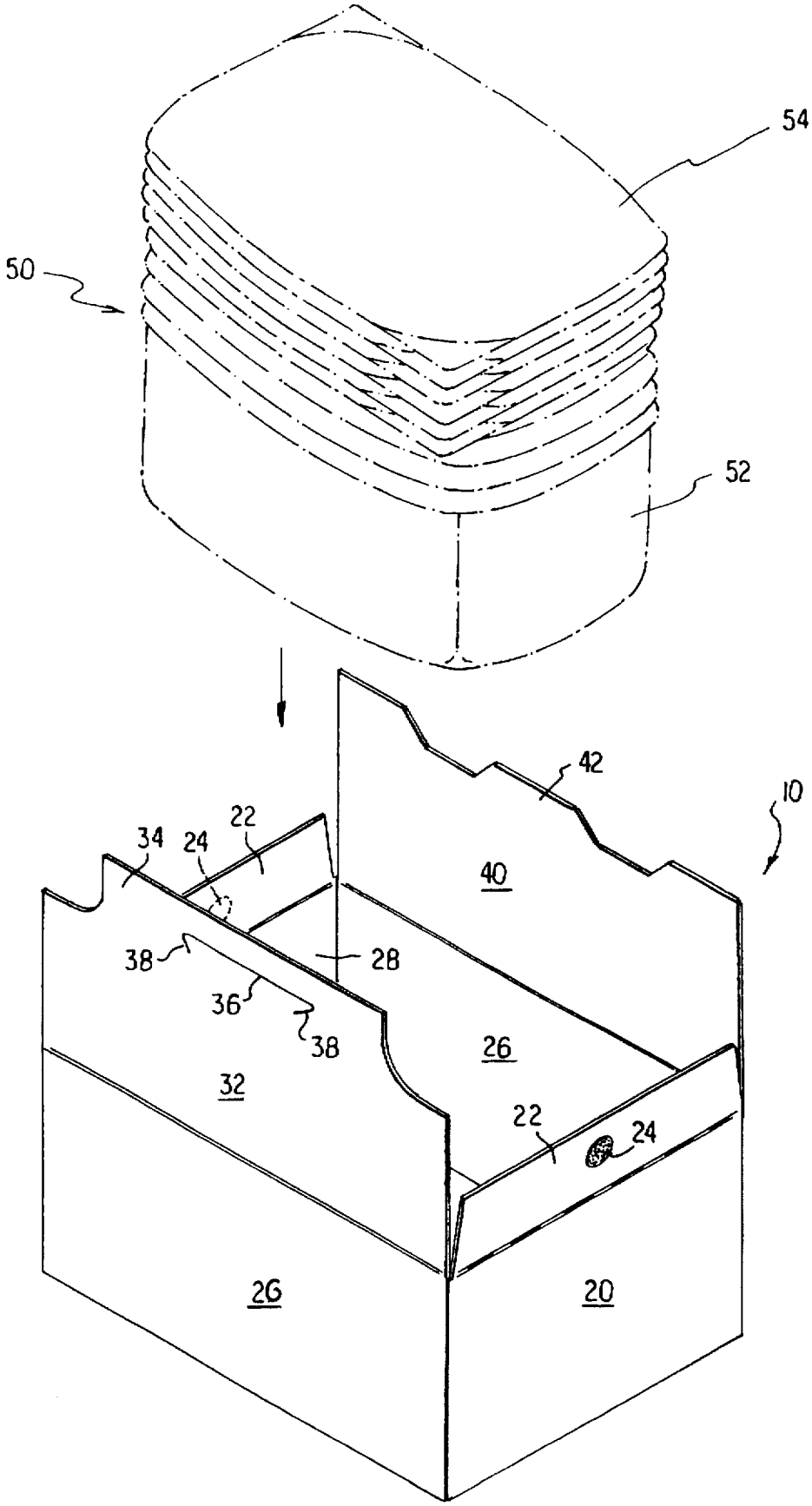
FIG. 2 is a perspective view of the blank of FIG. 1 after it has been partially erected and ready for insertion of a stack of nested containers and tops therefor, the latter shown in phantom lines.
Figure 3:
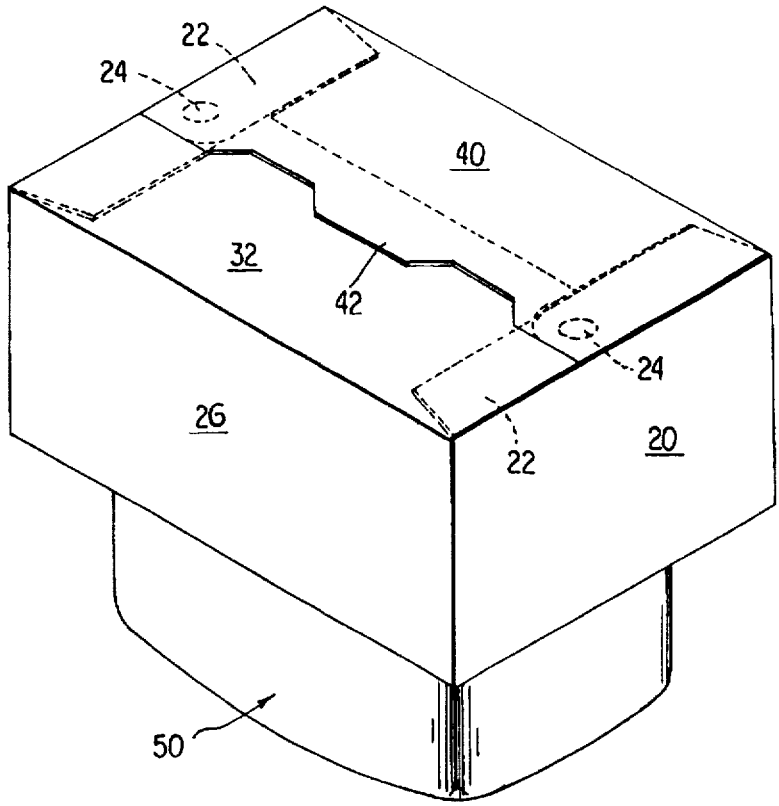
FIG. 3 is a perspective view of the assembled package prior to initial opening.
Figure 4:
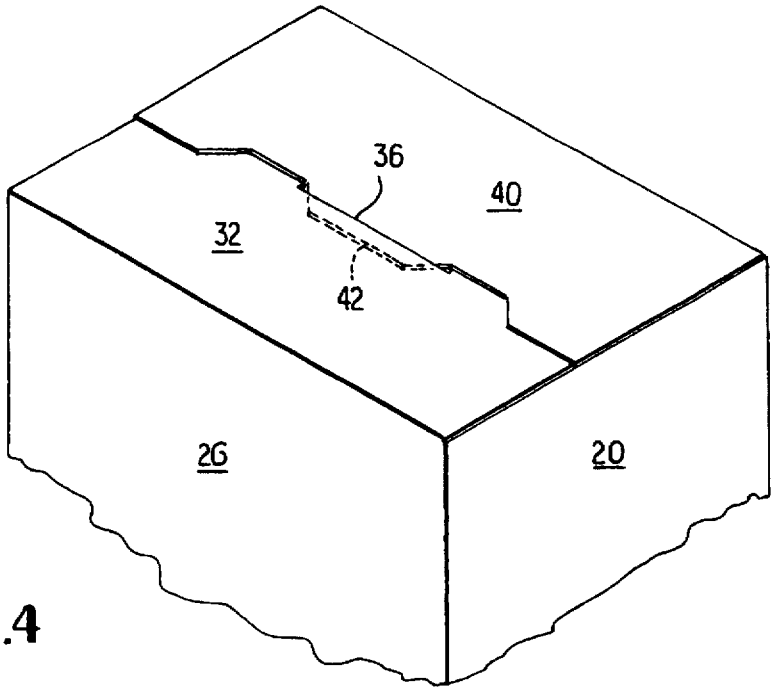
FIG. 4 is a partial view of the package of FIG. 3 after it has been opened and re-closed.

Referring now to FIG. 2, the side wall forming panels 20 and 26 have been folded 90 degrees upwardly, with panels 28 (only one of which is seen at FIG. 2) glued to the inside of respective wall panels 20. At this point, a nested stack 50 of plastic tubs 52 and top closures 54 therefor are inserted into the open, partially erected carton. Each tub has a flange, the flange of the lowest container of the nested stack resting the top rim of the opening of bottom panel 12. Then, partial roof or tuck panels 22 and then main roof panels 32 and 40 are folded towards each other, panel 40 partially overlying panel 32. Glue spots 24, such as hot melt, are engaged by respective surface portions of roof panel 40, as seen at the phantom lines of FIG. 3. The fully assembled package is shown at FIG. 3, with adhesive spots 24 temporarily securing roof panel 40 to the upper surfaces of tuck panels 22. FIG. 3 also shows that the reduced length zone 34, at the left of panel 32 of FIG. 1, is shorter than the distance between glue spots 24 of tuck panels 22.

The carton is opened by pulling up the free end of panel 40 to thereby overcome the force of adhesive spots 24. The main and tuck roof panels are bent upwardly, and stack 50 removed from the carton. After the desired number of tubs and covers have been taken, the remainder of stack 50 is reinserted into the carton, tuck roof panels 22 folded so as to be horizontal, and main roof panels 32 and 40 refolded so as to be substantially coplanar. To carry out this latter refolding, the user manually inserts tongue 42 through slit 36.

I claim:

1. A package including a plurality of nested and stacked containers and a paperboard carton, said carton fashioned from a unitary blank of paperboard, said carton including two opposite main roof panels, two opposite tuck panels, side wall panels, and a bottom panel, said roof and tuck panels carried by respective ones of said side panels, said two main roof panels each having respective free edges which overlap to thereby close said carton, one of said two main roof panels being the uppermost of said two main roof panels and the other being the lowermost of said two main roof panels, an opening in said bottom panel, each of said containers of said nested stack having a flange, said nested stack of containers extending partially through said bottom panel opening, said flanges of said nested stack located above said bottom panel, said stack having a lowermost container whose said flange rests on said bottom panel, said two main roof panel free edges having respective latch elements to thereby enable latching together said roof panels in substantial coplanar relationship to each other, said tuck panels each located beneath said two main roof panels, said tuck panels each having an adhesive spot on a respective upper surface thereof, said adhesive spots each being in contact with a respective lower surface portion of said uppermost main roof panel, whereby initial opening of said main roof and tuck panels is effected by pulling upwardly on said uppermost main roof panel to overcome the force of said adhesive spots, and whereby subsequent refolding of said roof panels is effected by securing said latch elements together.

2. The package of claim 1 wherein said latch elements are defined by a tongue on said free edge of said uppermost main roof panel and a slit on said free edge of said lowermost main roof panel.

3. The package of claim 1 wherein said lowermost main roof panel free edge includes a zone of reduced length, said reduced length zone being of lesser length than the distance between respective said adhesive spots on respective said tuck panels.

* * * * *